US011162484B2

(12) United States Patent
Peotter et al.

(10) Patent No.: US 11,162,484 B2
(45) **Date of Patent: *Nov. 2, 2021**

(54) SERVICE PACK COMPRISING AN ENGINE DRIVING A PNEUMATIC AIR COMPRESSION SYSTEM WITH A FLOW CONTROL SYSTEM TO ADJUST A POSITION OF A PROPORTIONAL CONTROL VALVE, REGULATE A VARIABLE PRESSURE ACTING ON A FLOW CONTROL MEMBER, AND REGULATE A POWER DEMAND PLACED ON THE ENGINE

(71) Applicant: Illinois Tool Works Inc., Glenview, IL (US)

(72) Inventors: Benjamin Gene Peotter, Kaukauna, WI (US); Mark E. Peters, New London, WI (US)

(73) Assignee: Illinois Tool Works Inc., Glenview, IL (US)

( * ) Notice: Subject to any disclaimer, the term of this patent is extended or adjusted under 35 U.S.C. 154(b) by 321 days.

This patent is subject to a terminal disclaimer.

(21) Appl. No.: 16/272,688

(22) Filed: Feb. 11, 2019

(65) Prior Publication Data

US 2019/0170129 A1 Jun. 6, 2019

Related U.S. Application Data

(63) Continuation of application No. 13/600,106, filed on Aug. 30, 2012, now Pat. No. 10,202,968.

(51) Int. Cl.

| | |
|---|---|
| ***F04B 35/00*** | (2006.01) |
| ***F04B 49/03*** | (2006.01) |
| ***F04B 49/22*** | (2006.01) |

(52) U.S. Cl.
CPC ..... *F04B 35/002* (2013.01); *F04B 49/03* (2013.01); *F04B 49/225* (2013.01)

(58) Field of Classification Search
CPC ..... F04B 35/002; F04B 49/03; F04B 49/225; B23K 9/1075; B23K 9/1081
(Continued)

(56) References Cited

U.S. PATENT DOCUMENTS

| | | | |
|---|---|---|---|
| 4,406,589 | A | 9/1983 | Tsuchida |
| 5,533,873 | A | 7/1996 | Kindl |

(Continued)

FOREIGN PATENT DOCUMENTS

| | | |
|---|---|---|
| GB | 2116754 | 9/1983 |
| WO | 2007019651 | 2/2007 |

OTHER PUBLICATIONS

International Search Report from PCT application No. PCT/US2012/071711 dated May 8, 2013 (2 pages).

(Continued)

*Primary Examiner* — Patrick Hamo
*Assistant Examiner* — Benjamin Doyle
(74) *Attorney, Agent, or Firm* — McAndrews, Held & Malloy, Ltd.

(57) ABSTRACT

Provided herein are systems that enable proportional air flow delivery control for an air compressor. One system includes a pneumatic air compression system having a flow control member and being adapted to receive inlet air and to compress the inlet air to produce compressed air. The system also includes a pneumatic flow control system including a proportional control valve having a proportionally variable activation state. Varying the activation state of the proportional control valve regulates a pressure acting on the flow control member to regulate the flow of the compressed air produced by the pneumatic air compression system in a (Continued)

variable manner, and further regulates a power demand placed on the engine by the pneumatic air compression system in a variable manner.

20 Claims, 5 Drawing Sheets

(58) Field of Classification Search
USPC ..... 219/133; 417/293
See application file for complete search history.

(56) References Cited

U.S. PATENT DOCUMENTS 6,146,100 A * 11/2000 Broucke ..... F04B 49/20 417/28
6,604,908 B1 8/2003 Bryant
6,857,618 B2 2/2005 Ludwig
7,607,899 B2 10/2009 VanPraag
7,648,343 B2 1/2010 Cornwell
7,789,102 B2 * 9/2010 Beckman ..... F04B 49/20 137/492.5
7,870,915 B2 * 1/2011 Beeson ..... B60P 3/14 180/53.1
10,202,968 B2 * 2/2019 Peotter ..... F04B 49/225
2005/0111997 A1 5/2005 Smith
2008/0264922 A1 * 10/2008 Fosbinder ..... F02B 63/02 219/133
2009/0194067 A1 * 8/2009 Peotter ..... F02D 41/0205 123/350
2010/0199753 A1 8/2010 Renner
2010/0199950 A1 * 8/2010 Renner ..... F02D 41/0205 123/347

OTHER PUBLICATIONS

Rotor Verdichter, Operating Manual—NK 40; [en] Sep. 2008; pp. 3.2-3.3.

* cited by examiner

SERVICE PACK COMPRISING AN ENGINE DRIVING A PNEUMATIC AIR COMPRESSION SYSTEM WITH A FLOW CONTROL SYSTEM TO ADJUST A POSITION OF A PROPORTIONAL CONTROL VALVE, REGULATE A VARIABLE PRESSURE ACTING ON A FLOW CONTROL MEMBER, AND REGULATE A POWER DEMAND PLACED ON THE ENGINE

RELATED APPLICATIONS/INCORPORATION BY REFERENCE

The present application is a continuation of U.S. application Ser. No. 13/600,106 filed Aug. 30, 2012. The above-identified application is hereby incorporated herein by reference in its entirety.

BACKGROUND

The invention relates generally to control systems and methods for air compressors, and, more specifically, to proportional air flow delivery control for air compressors.

A prime mover (e.g., an engine), for example, of a work vehicle service pack, generally drives various loads, such as an air compressor, an electrical generator, and a hydraulic pump. These various loads can potentially overload the prime mover, reduce fuel efficiency, increase pollutant emissions, and so forth. For example, in instances in which a prime mover drives an air compressor, sustained delivery of air flow at a given pressure may necessitate that a substantial portion of the output of the prime mover be devoted to operating the air compressor. In such instances, the operational power demands of the air compressor may effectively limit the power that the prime mover has available to support other loads.

While the operational power demands of air compressors may limit the quantity of devices that a prime mover can support, or may lead to the need to utilize a larger prime mover, such air compressors may be still be desired in a variety of applications. For example, due to their portability and efficiency (relative to devices with comparable capabilities), such air compressors are often utilized in applications in which it is desired to convert electrical current into mechanical energy in the form of pneumatic pressure. For instance, air compressors may be utilized in industrial, commercial, or home maintenance applications, or any other application in which compressed air may be utilized to drive operation of a device. Accordingly, it may be desirable to provide improved air compressor systems that address some of the drawbacks associated with typical air compressor operation.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In one embodiment, a system includes an engine and a pneumatic air compression system driven by the engine. The pneumatic air compression system has a flow control member and is adapted to receive inlet air and to compress the inlet air to produce compressed air. The system also includes a pneumatic flow control system including a proportional control valve having a proportionally variable activation state. Varying the activation state of the proportional control valve regulates a pressure acting on the flow control member to regulate the flow of the compressed air produced by the pneumatic air compression system in a variable manner, and further regulates a power demand placed on the engine by the pneumatic air compression system in a variable manner.

In another embodiment, a system includes an engine and a pneumatic air compression system driven by the engine and adapted to produce compressed air from inlet air. The pneumatic air compression system includes an inlet valve and an inlet valve control piston adapted to actuate the inlet valve via pressure within the inlet valve control piston. The system also includes a pneumatic flow control system including a proportional control valve having a proportionally variable activation state. Further, the system includes a controller adapted to vary the activation state of the proportional control valve to regulate the pressure within the inlet valve control piston to proportionally regulate a position of the inlet valve to regulate the flow of the compressed air produced by the pneumatic air compression system in a variable manner, and to further regulate a power demand placed on the engine by the pneumatic air compression system in a variable manner.

In another embodiment, a system includes an engine and a pneumatic air compression system driven by the engine, having a flow control member, and being adapted to receive inlet air and to compress the inlet air to produce compressed air. The system also includes a pneumatic flow control system including a manual control valve having a proportionally variable activation state. Varying the activation state of the proportional control valve regulates a pressure acting on the flow control member to regulate the flow of the compressed air produced by the pneumatic air compression system in a variable manner, and to regulate a power demand placed on the engine by the pneumatic air compression system in a variable manner.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
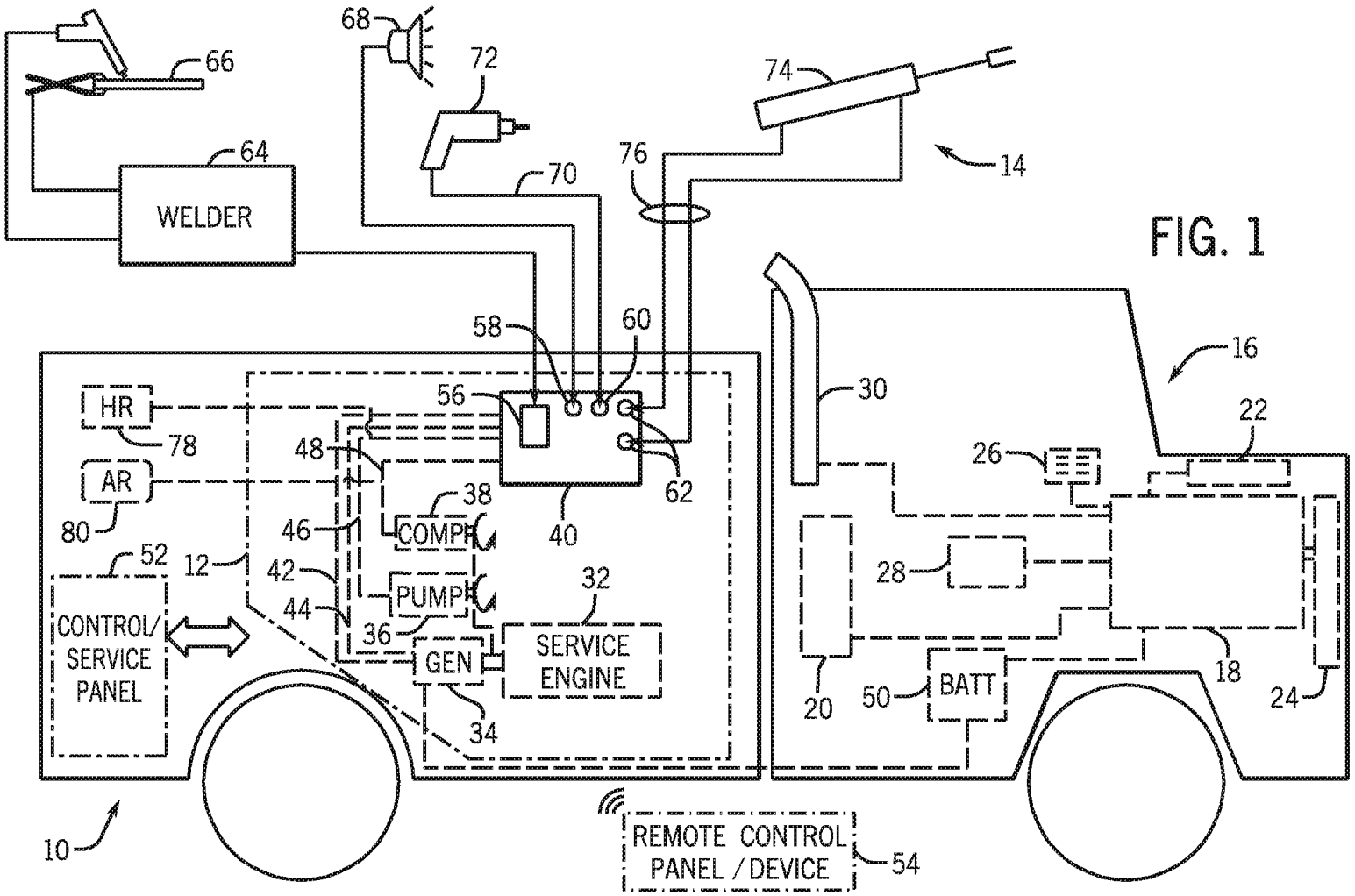
FIG. 1 is a schematic diagram of a work vehicle having a service pack with an air compressor that is capable of proportional air flow delivery in accordance with one embodiment.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As described in more detail below, provided herein are embodiments of air compression systems in which the flow of compressed air from such systems is provided in a variable manner, and the amount of power necessary to provide the air flow from the compressor at a given pressure is controlled. More specifically, presently disclosed embodiments provide for direct control over the amount of air flow delivered by the air compressor and, via that control, provide for the control and limiting of the amount of power needed to power operation of the air compressor. The foregoing feature may offer distinct advantages in systems in which a prime mover (e.g., an engine) powers multiple devices because the foregoing embodiments may enable multiple loads, in addition to the pressurized air flow, to be placed on the system without overloading the prime mover. Additionally, such features may enable a smaller, more compact, and more efficient prime mover to deliver high air flow rates at low pressures while also providing high pressure at a lower, regulated air flow rate. These and other features of the presently contemplated embodiments are described in more detail below.

In certain embodiments, a control system may be configured to control an air compressor to provide the desired amount of air flow, and the air compressor may be a part of a service pack mounted on a work vehicle or other mobile application. The control system may ensure that the air compressor delivers an adequate amount of air pressure based on a load applied to the air compressor. However, it should be noted that although certain embodiments of the air compressor and/or the control system may be part of a service pack for a work vehicle, other embodiments of the systems provided below may be utilized in other contexts. Indeed, the provided air compression systems and methods of controlling such systems may be utilized in a variety of implementation-specific system contexts, not limited to those provided below merely for the sake of example.

Turning now to the illustrated example, FIG. 1 illustrates a work vehicle 10 in accordance with one presently disclosed embodiment. The work vehicle 10 is illustrated as a work truck, although any suitable configuration for the work vehicle 10 may be utilized. In the illustrated embodiment, the work vehicle 10 includes a service pack 12 for supplying electrical power, compressed air, and hydraulic power to a range of applications, designated generally by reference numeral 14. The work vehicle 10 has a main vehicle power plant 16 based around a work vehicle engine 18. Although the invention is not limited to any particular configuration or equipment, work vehicle engines of this type will typically be diesel engines, although gasoline engines may be used in some vehicles.

The vehicle power plant 16 may include a number of conventional support systems. For example, the work vehicle engine 18 may consume fuel from a fuel reservoir 20, typically one or more liquid fuel tanks. An air intake or air cleaning system 22 may supply air to the work vehicle engine 18, which may, in certain applications, be turbocharged or super-charged. A cooling system 24, which may typically include a radiator, a circulation pump, a thermostat-controlled valve, and a fan, may provide for cooling the work vehicle engine 18. An electrical system 26 may include an alternator or generator, along with one or more system batteries, cabling for these systems, cable assemblies routing power to a fuse box or other distribution system, and so forth. A lube oil system 28 may typically be included for many engine types, such as for diesel engines. Such lube oil systems 28 typically draw oil from the diesel engine crankcase and circulate the oil through a filter and cooler, if present, to maintain the oil in good working condition. Finally, the power plant 16 may be served by an exhaust system 30, which may include catalytic converters, mufflers, and associated conduits.

The service pack 12 may include one or more service systems driven by a service engine 32. In one embodiment, the service pack 12 may provide electrical power, hydraulic power, and compressed air for the various applications 14. In the diagrammatical representation of FIG. 1, for example, the service engine 32 may drive a generator 34, a hydraulic pump 36, and an air compressor 38. The service engine 32 may be of any desired type, such as a diesel engine. However, certain embodiments may use gasoline engines or other types of engines. The generator 34 may be directly driven by the service engine 32, such as by close coupling the generator 34 to the service engine 32, or may be belt-driven or chain-driven. The generator 34 may include three-phase brushless types, capable of producing power for a range of applications. However, other types of generators 34 may be employed, including single-phase generators and generators capable of producing multiple power outputs. The hydraulic pump 36 may be based on any conventional technology, such as piston pumps, gear pumps, vane pumps, and so forth and may be used with or without closed-loop control of pressure and/or flow.

Further, the air compressor 38 may also be of any suitable implementation-specific type of air compressor. However, the air flow provided by the air compressor 38 is capable of being regulated in a variable manner to provide for a variable power consumption level experienced by the prime mover that supplies power to the air compressor 38. That is, as described in more detail below, the air compressor 38 provides pressurized air flow at a reduced level of power, thus enabling the prime mover to also support a variety of other loads.

The systems of the service pack 12 may include appropriate conduits, wiring, tubing, and so forth for conveying the service generated by these components to an access point 40. Convenient access points 40 may be located around the periphery of the work vehicle 10. In a presently contemplated embodiment, all of the services may be routed to a common access point 40, although multiple access points 40 may certainly be utilized. The diagrammatical representation of FIG. 1 illustrates the generator 34 as being coupled to electrical cabling 42 (for AC power supply) and 44 (for 12-volt DC power supply), whereas the hydraulic pump 36 is coupled to a hydraulic circuit 46, and the air compressor 38 is coupled to an air circuit 48. The wiring and circuitry for all three systems will typically include protective circuits for the electrical power (e.g., fuses, circuit breakers, and so forth) as well as valving for the hydraulic and air service. For the supply of electrical power, certain types of power may be conditioned (e.g., smoothed, filtered, and so forth), and 12-volt power output may be provided by rectification, filtering, and regulating of the AC output. Valving for hydraulic power output may include, by way example, pressure relief valves, check valves, shut-off valves, as well as directional control valving.

In certain embodiments, the generator 34 may be coupled to the work vehicle electrical system 26, and particularly to the work vehicle battery 50. Thus, as described below, not only may the service pack 12 allow for 12-volt loads to be powered without operation of the main work vehicle engine 18, but the work vehicle battery 50 may serve as a shared battery, and may be maintained in a good state of charge by the service pack generator output.

The cabling, circuits, and conduits 42, 44, 46, and 48 may route service for all of these systems directly from connections on the service pack 12. For example, connections may be provided at or near the access point 40 of the service pack 12, such that connections can easily be made without the need to open an enclosure of the access point 40. Moreover, certain control functions may be available from a control and service panel 52. The control and service panel 52 may be located on any surface of the work vehicle 10 or at multiple locations on the work vehicle 10, and may be covered by doors or other protective structures. The control and service panel 52 need not be located at the same location, or even near the locations of the access point 40 to the electrical, hydraulic, and compressed air output points of the service pack 12. For example, the control and service panel 52 may be provided in a rear compartment covered by an access door. The control and service panel 52 may permit, for example, starting and stopping of the service engine 32 by a keyed ignition or starter button. Other controls for the service engine 32 may also be provided on the control and service panel 52. The control and service panel 52 may also provide operator interfaces for monitoring the service engine 32, such as fuel level gages, pressure gages, as well as various lights and indicators for parameters such as pressure, speed, and so forth. The control and service panel 52 may also include a stop, disconnect, or disable switch that allows the operator to prevent starting of the service engine 32, such as during transport.

As also illustrated in FIG. 1, a remote control panel or device 54 may also be provided that may communicate with the control and service panel 52 or directly with the service pack 12 wirelessly. The operator may start and stop the service pack engine 32, and control certain functions of the service pack 12 (e.g., engagement or disengagement of a clutched component, such as the air compressor 38) without directly accessing either the components within the service pack 12 or the control and service panel 52.

As noted above, any desired location may be selected as a convenient access point 40 for one or more of the systems of the service pack 12. In the illustrated embodiment, for example, one or more alternating current electrical outputs, which may take the form of electrical receptacles 56 (for AC power) and 58 (for 12-volt DC power) may be provided. Similarly, one or more pneumatic connections 60, typically in the form of a quick disconnect fitting, may be provided. Similarly, hydraulic power and return connections 62 may be provided, which may also take the form of quick disconnect fittings.

In the embodiment illustrated in FIG. 1, the applications 14 may be coupled to the service pack 12 by interfacing with the outputs provided by the AC electrical receptacle 56. For example, a portable welder 64 may be coupled to the AC electrical receptacle 56, and may provide power suitable for a welding application 66. More specifically, the portable welder 64 may receive power from the electrical output of the generator 34, and may contain circuitry designed to provide for appropriate regulation of the output power provided to cables suitable for the welding application 66. The presently contemplated embodiments include welders, plasma cutters, and so forth, which may operate in accordance with any one of many conventional welding techniques, such as stick welding, tungsten inert gas (TIG) welding, metal inert gas (MIG) welding, and so forth. Although not illustrated in FIG. 1, certain of these welding techniques may call for or conveniently use wire feeders to supply a continuously fed wire electrode, as well as shielding gases and other shielding supplies. Such wire feeders may be coupled to the service pack 12 and be powered by the service pack 12.

Similarly, DC loads may be coupled to the DC receptacle 58. Such loads may include lights 68, or any other loads that would otherwise be powered by operation of the main work vehicle engine 18. The 12-volt DC output of the service pack 12 may also serve to maintain the work vehicle battery charge, and to power any ancillary loads that the operator may need during work (e.g., cab lights, hydraulic system controls, and so forth).

The pneumatic and hydraulic applications may similarly be coupled to the service pack 12 as illustrated in FIG. 1. For example, a hose 70 or other conduit may be routed from the compressed air source at the outlet 60 to a pneumatic load 72, such as an impact wrench. However, many other types of pneumatic loads 72 may be utilized. Similarly, a hydraulic load 74, such as a reciprocating hydraulic cylinder may be coupled to the hydraulic service 62 by means of appropriate hoses or conduits 76. As noted above, certain of these applications, particularly the hydraulic applications, may call for the use of additional valving. Such valving may be incorporated into the work vehicle 10 or may be provided separately either in the application itself or intermediately between the service pack 12 and the hydraulic actuators. It should also be noted that certain of the applications 14 illustrated in FIG. 1 may be incorporated into the work vehicle 10. For example, the work vehicle 10 may be designed to include a man lift, scissor lift, hydraulic tail gate, or any other driven systems which may be coupled to the service pack 12 and driven separately from the main work vehicle engine 18.

The service pack 12 may be physically positioned at any suitable location in the work vehicle 10. For example, the service engine 32 may be mounted on, beneath or beside the vehicle bed or work platform rear of the vehicle cab. In many such work vehicles 10, for example, the work vehicle chassis may provide convenient mechanical support for the service engine 32 and certain of the other components of the service pack 12. For example, steel tubing, rails, or other support structures extending between front and rear axles of the work vehicle 10 may serve as a support for the service engine 32. Depending upon the system components selected and the placement of the service pack 12, reservoirs may also be provided for storing hydraulic fluid and pressurized air, such as hydraulic reservoir 78 and air reservoir 80. However, the hydraulic reservoir 78 may be placed at various locations or even integrated into an enclosure of the service pack 12. Likewise, depending upon the air compressor 38 selected, no air reservoir 80 may be used for compressed air.

The service pack 12 may provide power for on-site applications completely separately from the work vehicle engine 18. That is, the service engine 32 may generally not be powered during transit of the work vehicle 10 from one service location to another, or from a service garage or facility to a service site. Once located at the service site, the work vehicle 10 may be parked at a convenient location, and the main work vehicle engine 18 may be shut down. The service engine 32 may then be powered to provide service from one or more of the service systems described above. In certain embodiments, clutches or other mechanical engagement devices may be provided for engagement and disengagement of one or more of the generator 34, the hydraulic pump 36, and the air compressor 38. Moreover, where stabilization of the work vehicle 10 or any of the systems is beneficial, the work vehicle 10 may include outriggers, stabilizers, and so forth, which may be deployed after parking the work vehicle 10 and prior to operation of the service pack 12.

Figure 2:
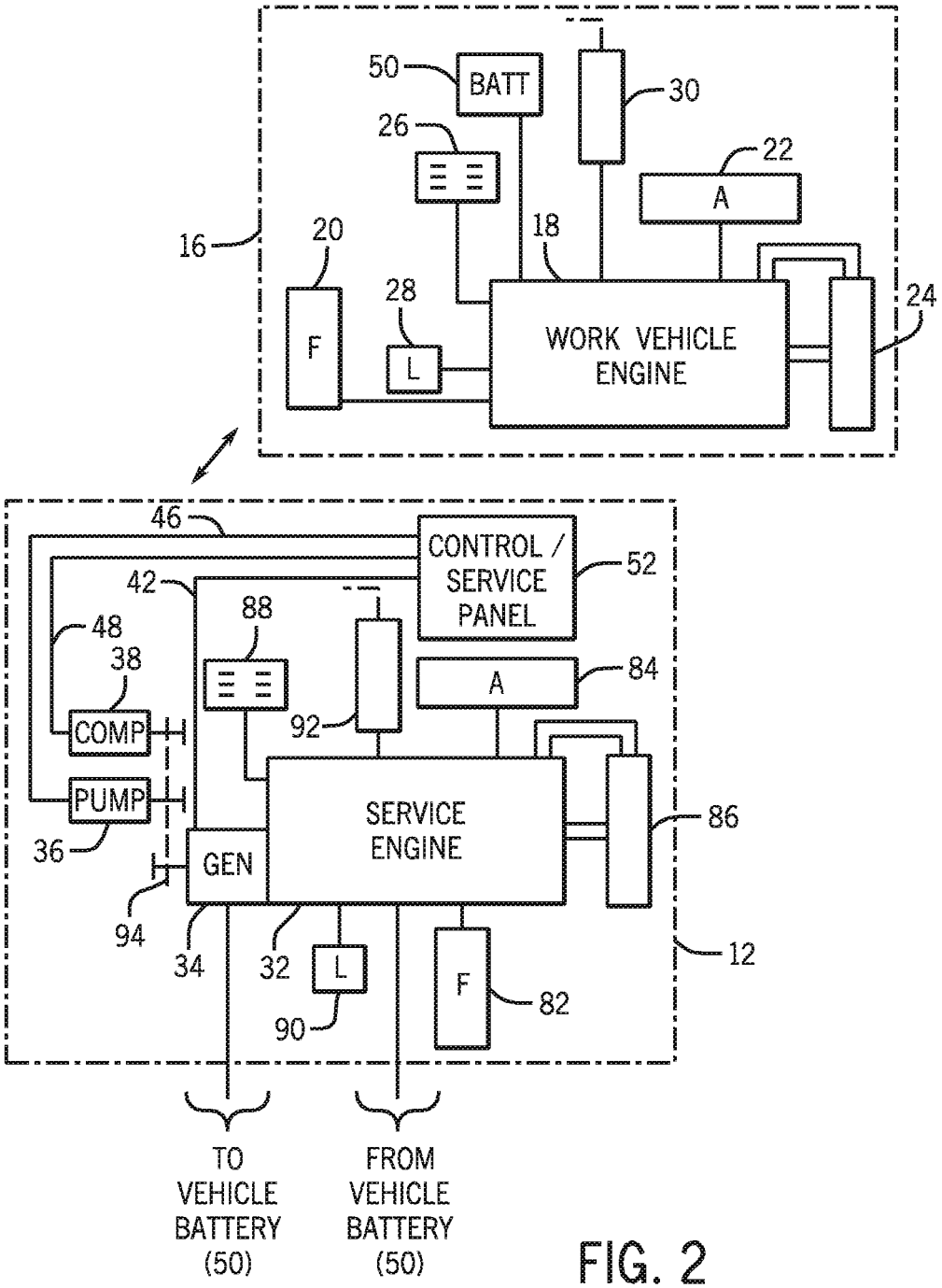
FIG. 2 is a schematic diagram of an embodiment of power systems in the work vehicle of FIG. 1, illustrating support systems of the service pack separate and independent from support systems of a work vehicle engine.

Several different scenarios may be implemented for driving the components of the service pack 12, and for integrating or separating the support systems of the service pack 12 from those of the work vehicle power plant 16. One such approach is illustrated in FIG. 2, in which the service pack 12 is entirely independent and operates completely separately from the work vehicle power plant 16. In the embodiment illustrated in FIG. 2, the support systems for the work vehicle power plant 16 are coupled to the work vehicle engine 18 in the manner set forth above. In this embodiment, the service pack 12 may reproduce some or all of these support systems for operation of the service engine 32. For example, these support systems may include a separate fuel reservoir 82, a separate air intake or air cleaning system 84, a separate cooling system 86, a separate electrical protection and distribution system 88, a separate lube oil system 90, and a separate exhaust system 92.

Many or all of these support systems may be provided local to the service engine 32, in other words, at the location where the service engine 32 is supported on the work vehicle 10. On larger work vehicles 10, access to the location of the service engine 32, and the service pack 12 in general, may be facilitated by the relatively elevated clearance of the work vehicle 10 over the ground. Accordingly, components such as the fuel reservoir 82, air intake or air cleaning system 84, cooling system 86, electrical protection and distribution system 88, and so forth, may be conveniently positioned so that these components can be readily serviced. Also, the hydraulic pump 36 and air compressor 38 may be driven by a shaft extending from the generator 34, such as by one or belts or chains 94. As noted above, one or both of these components, or the generator 34 itself, may be provided with a clutch or other mechanical disconnect to allow them to idle while other systems of the service pack 12 are operative.

Figure 3:
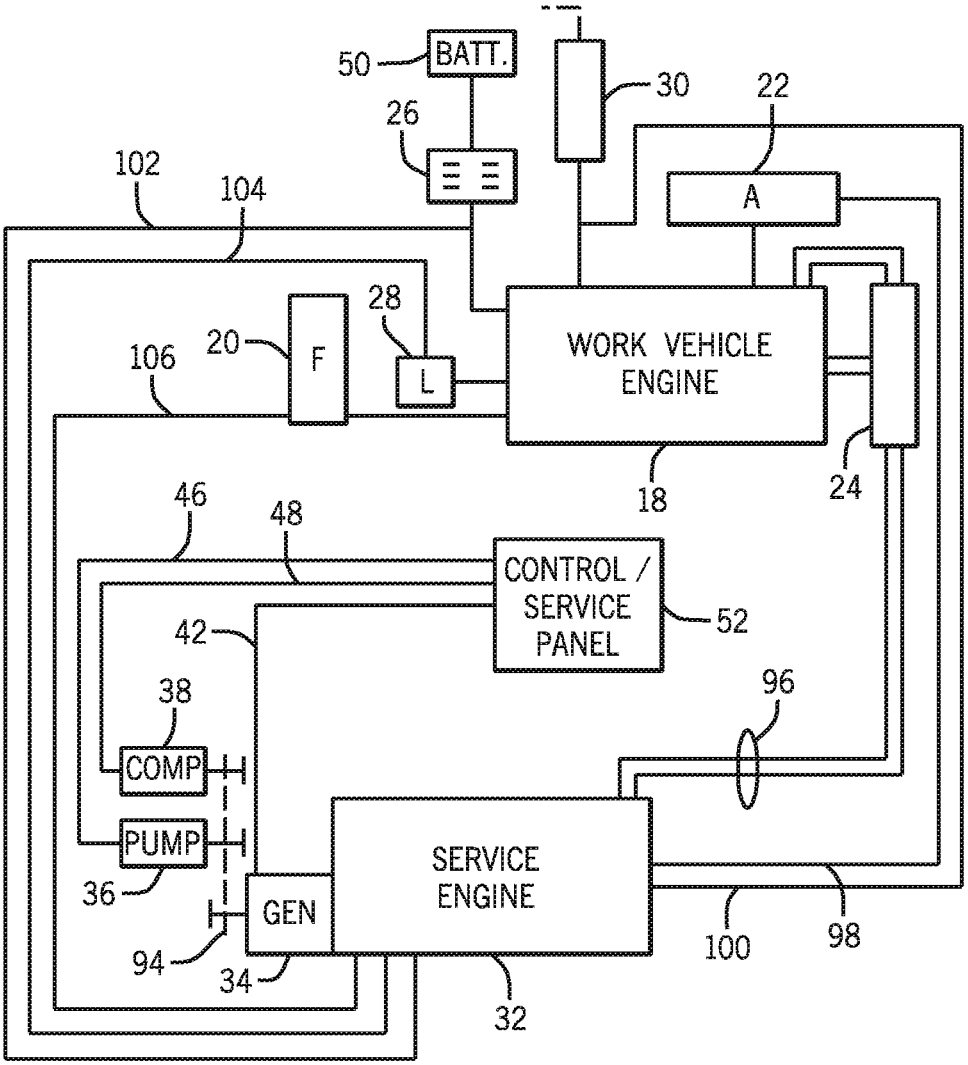
FIG. 3 is a schematic diagram of an embodiment of power systems in the work vehicle of FIG. 1, illustrating support systems of the service pack integrated with support systems of the work vehicle engine.

FIG. 3 represents an alternative configuration in which the service pack 12 support systems are highly integrated with those of the main work vehicle power plant 16. In the illustrated embodiment of FIG. 3, for example, all of the systems described above may be at least partially integrated with those of the work vehicle power plant 16. Thus, coolant lines 96 may be routed to and from the work vehicle cooling system 24 of the work vehicle 10, while an air supply conduit 98 may be routed from the air intake and cleaning system 22 of the work vehicle 10. Similarly, an exhaust conduit 100 may route exhaust from the service engine 32 to the exhaust system 30 of the work vehicle 10. The embodiment of FIG. 3 also illustrates integration of the electrical systems of the work vehicle 10 and the service pack 12, as indicated generally by electrical cabling 102, which may route electrical power to and from the distribution system 26 of the work vehicle 10. The systems may also integrate lube oil functions, such that lubricating oil may be extracted from both crank cases in common, to be cleaned and cooled, as indicated by conduit 104. Finally, a fuel conduit 106 may draw fuel from the main fuel reservoir 20 of the work vehicle 10, or from multiple reservoirs where such multiple reservoirs are present on the work vehicle 10.

In presently contemplated embodiments, integrated systems of particular interest include electrical and fuel systems. For example, while the generator 34 of the service pack 12 may provide 110-volt AC power for certain applications, its ability to provide 12-volt DC output may be particularly attractive to supplement the charge on the work vehicle battery 50, for charging other batteries, and so forth. The provision of both power types, however, makes the system even more versatile, enabling 110-volt AC loads to be powered (e.g., for tools, welders, and so forth) as well as 12-volt DC loads (e.g., external battery chargers, portable or cab-mounted heaters or air conditioners, and so forth).

Integrated solutions between those of FIG. 2 and FIG. 3 may also be utilized. For example, some of the support systems may be separated in the work vehicle 10 both for functional and mechanical reasons. Embodiments of the present invention thus contemplate various solutions between those shown in FIG. 2 and FIG. 3, as well as some degree of elimination of redundancy between these systems. For instance, at least some of the support systems for the main work vehicle engine 18 may be used to support the service pack 12. For example, at least the fuel supply and electrical systems may be at least partially integrated to reduce the redundancy of these systems. The electrical system may thus serve certain support functions when the work vehicle engine 18 is turned off, removing dependency from the electrical system, or charging the vehicle battery 50. Similarly, heating, ventilating, and air conditioning systems may be supported by the service pack engine 32, such as to provide heating of the work vehicle 10 when the main work vehicle engine 18 is turned off. Thus, more or less integration and removal of redundancy may be possible.

Figure 4:
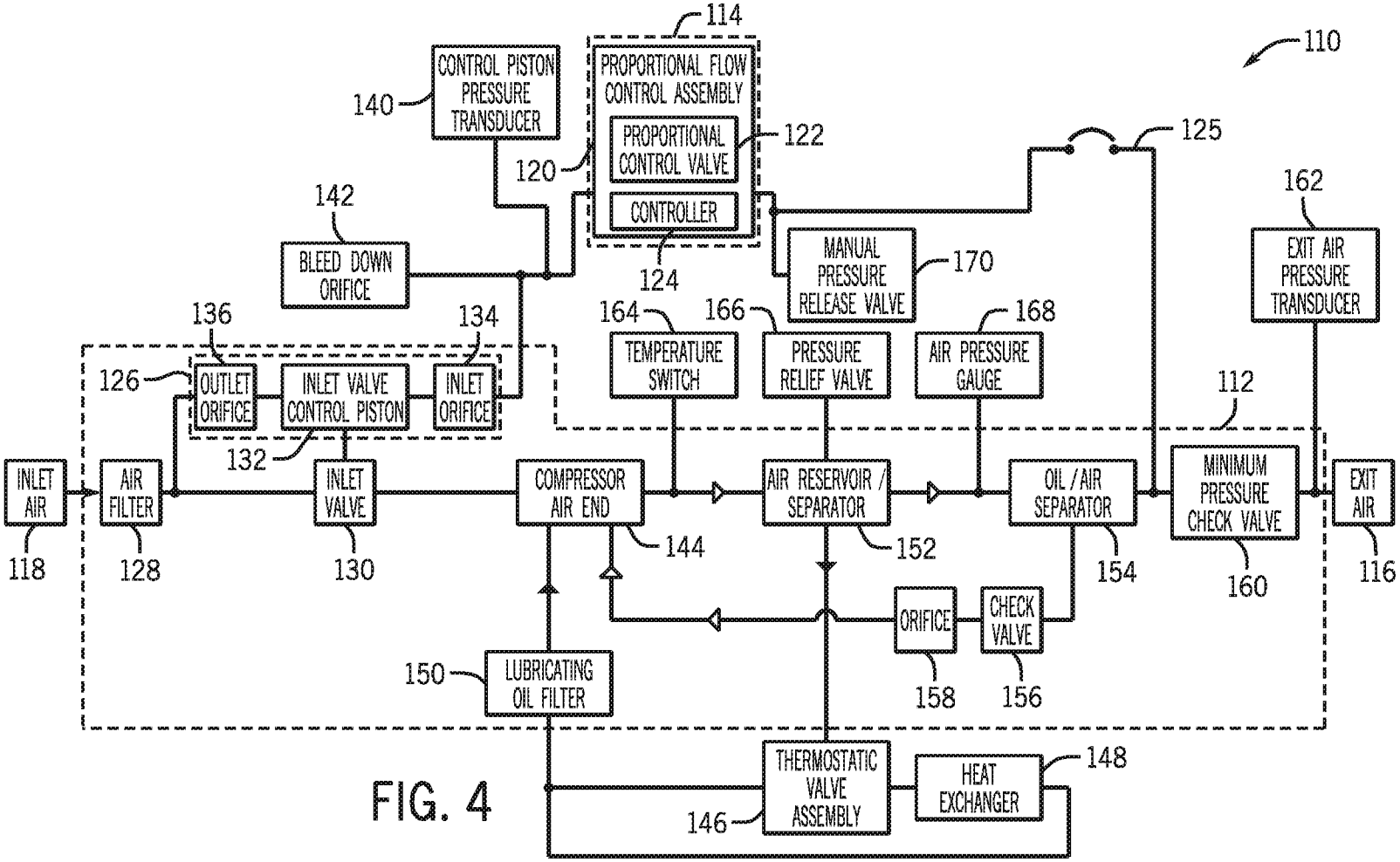
FIG. 4 is a block diagram illustrating an embodiment of an air compressor system including a proportional flow control assembly.

Turning now to FIG. 4, an air compression system 110, which may be provided, for example, as the air compressor 38 that provides pressurized air in the embodiments of FIGS. 1-3, is illustrated. The air compression system 110 includes a pneumatic air compression system 112 and a pneumatic flow control system 114. During operation, the pneumatic flow control system 114 exhibits control over at least one component of the pneumatic air compression system 112 to regulate a flow of exit air 116 compressed from inlet air 118 in a variable manner, as discussed in more detail below. It should be noted that the foregoing control exhibited directly over the delivery of the compressed exit air 116 indirectly leads to control over the amount of power needed to delivery the exit air 116 at a given pressure, thereby enabling the power demands of the overall system to be reduced.

In the illustrated embodiment, the pneumatic flow control system 114 includes a proportional flow control assembly 120. The proportional flow control assembly 120 includes a proportional control valve 122 and a controller 124. Further, the pneumatic air compression system 112 includes an inlet valve control piston system 126 that cooperates with a variety of other implementation-specific components of the pneumatic air compression system 112 and external components to compress the inlet air 118 to produce the exit air 116 under control of the proportional flow control assembly 120. However, it should be noted that in other embodiments, the valve control piston system 126 may be replaced by any suitable flow control system having a suitable flow control member, which may be but is not limited to a piston, spool, diaphragm, poppet, and so forth.

During operation of the air compression system 110, the inlet air 118 is drawn, for example, at an ambient temperature and pressure from the surrounding environment. An air filter 128 filters the air 118 to remove particulates. The air is then routed through a proportional inlet valve 130, which can be positioned in an open position, a closed position, or anywhere in between the open and closed positions. In certain embodiments, the position of the proportional inlet valve 130 is regulated, thereby regulating the flow of the air through the pneumatic air compression system 112 and controlling the amount of air flow delivered by the compression system.

For example, in the illustrated embodiment, an inlet valve control piston 132 actuates the inlet valve 130 via pressure inside the piston, and the pressure opposes the forces of a spring acting on the inlet valve 130. In the schematic of FIG. 4, an inlet orifice 134 represents the restriction of air flow to the control piston 132. Further, an outlet orifice 136 represents the restriction of air flow leaving the control piston 132 and returning to the inlet air flow stream. In the illustrated embodiment, the outlet orifice 136 is operated in conjunction with the proportional flow control assembly 120 to directly regulate the pressure in the control piston 132 to bring about indirect regulation of the position of the inlet valve 130.

More specifically, the proportional control valve 122 is controlled by the controller 124 to be in an open position, a closed position, or any desired position therebetween. The controller 124 regulates the position of the proportional control valve 122 to control the quantity and pressure of pilot air that is enabled to flow from an air pilot line 125 that routes pilot air pressure and flow to the flow control assembly 120. To that end, the controller 124 is in communication with a control piston pressure transducer 140 that provides feedback relating to the pressure acting on the control piston at a given time. Further, the controller 124 communicates with the pressure transducer 162 for the purpose of regulating the air pressure of the system. Still further, it should be noted that the proportional control valve 122 may be positioned in an open position or a closed position to enable a remotely located controller to remotely set the pressure regulation set point for the service pack system.

Further, a bleed down orifice 142 is utilized in conjunction with the pilot pressure and air flow to regulate the pressure acting on the control piston 132. Additionally, the bleed down orifice 142 may also enable the internal compressor pressure to bleed down to atmospheric pressure when the compressor has stopped and the proportional control valve 122 is in an open position.

It should be noted that although the embodiments described above utilize the inlet valve control piston 132, in other embodiments, a variety of other flow control members may be utilized. For example, suitable flow control members include but are not limited to a piston, spool, diaphragm, and poppet. Further, as the activation state of the proportional control valve is varied to regulate the pressure acting on the flow control member, the power demand placed on a prime mover (e.g., an engine) driving the pneumatic air compression system is also varied. That is, via regulation of the proportional control valve, the power demand placed on the prime mover that powers the air compression system may also be regulated.

Still further, in additional embodiments, one or more components of the pneumatic flow control system 114 may be directly coupled to the inlet valve 130 to enable direct regulation of the position of the inlet valve 130. For example, in one embodiment, a proportional solenoid may be directly coupled to the inlet valve 130 to provide for direct control over the inlet valve 130, thereby providing for control over the amount of air flow delivered by the air compressor. In this manner, the system 110 may be reconfigured in certain embodiments to provide for the coupling of the proportional control valve 122 to the inlet valve 130 to provide for the control and limiting of the amount of power needed to power operation of the air compressor.

In the illustrated embodiment, once the inlet air 118 flows through the inlet valve 130, a compressor air end 144 draws in the air, compresses the air to a higher pressure, and delivers the compressed air to the outlet. One or more of the components in the compressor may require oil for lubrication, and, accordingly, a system associated with such oil usage is provided. Specifically, in the illustrated embodiment, a thermostatic valve assembly 146 is utilized to regulate the temperature of the lubricating oil. Before the oil has reached a preset temperature, the oil is directed to the compressor air end 144 via a lubricating oil filter 150 that removes particulates from the oil. However, when the preset temperature has been reached, the oil is routed through a heat exchanger 148 before being sent to the filter 150 to reduce its temperature and reduce or prevent the likelihood of the oil overheating.

Further, an air reservoir/separator 152 separates and captures oil from the air/oil mixture delivered by the compressor air end 144, and an oil/air separator 154 further separates the oil from the air and drains the oil back to the compressor air end 144 via an oil scavenging check valve 156 and an oil scavenging orifice 158. While the oil is routed back to the compressor air end 144, the compressed air is routed toward the exit of the pneumatic air compression system 112. In the illustrated embodiment, the compressed air flows through a minimum pressure check valve 160 that enables only air that has reached a minimum preset pressure level to exit the system 112 as the exit air 116. An exit air pressure transducer 162 measures the pressure of the exit air 116 and electrically communicates that value to one or more suitable system controllers for control of the system 110 or a higher level system in which the system 110 is located.

Still further, during operation, a temperature switch 164 is biased toward a closed position, but when a temperature that exceeds a preset value is reached, the switch 164 opens, and the system 112 is shut down (e.g., a clutch driving the compressor is disengaged). Additionally, a pressure relief valve 166 is biased toward a closed position during normal operation but when a preset over-pressure limit is reached, the valve 166 opens and vents the compressor to the atmosphere. Further, an air pressure gauge 168 provides an operator a visual representation of the pressure within the air compressor, and a manual pressure release valve 170 may be manually opened by an operator to release the internal pressure of the compressor, for example, when the unit is powered down but high pressure remains inside the unit.

Figure 5:
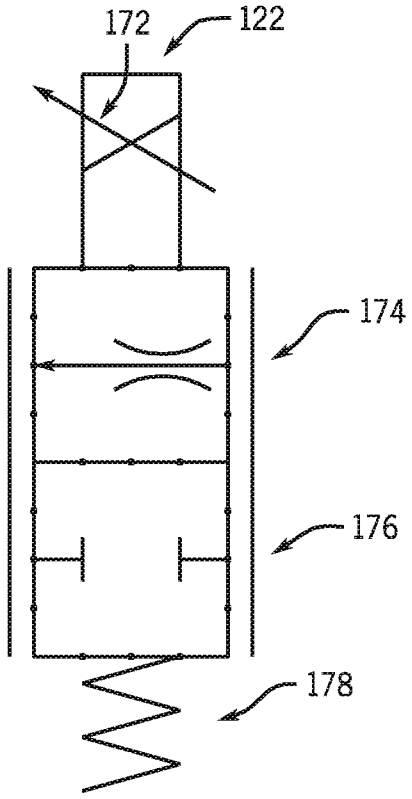
FIG. 5 is a schematic illustrating an embodiment of a proportional control valve that may be included in the proportional flow control assembly of FIG. 4.

FIG. 5 is a schematic illustrating an embodiment of the proportional control valve 122 that may be included in the proportional flow control assembly 120 of FIG. 4. As indicated by arrow 172, in this embodiment, the valve 122 is a variable solenoid. As shown, a first envelope 174 and a second envelope 176 indicate a two position valve having a closed position bias, indicated by arrow 178. However, because the valve 122 is variable, the valve 122 can be controlled to be in an open position, a closed position, or anywhere in between the open position and the closed position. That is, even though the illustrated valve 122 is biased toward a closed position, if fully energized, the valve may remain in a fully open position. It should be noted that the illustrated proportional control valve 122 is merely an example, and in accordance with presently contemplated embodiments, the valve 122 may be an electrically or manually activated valve capable of being manipulated into a variety of positions between open and closed positions, not limited to those shown and described herein.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A service pack, comprising:

an engine configured to drive a plurality of loads, the plurality of loads comprising a pneumatic air compression system that includes a flow control member, wherein the pneumatic air compression system is configured to receive inlet air and compress the inlet air to produce compressed air; and a pneumatic flow control system comprising a proportional control valve, wherein the pneumatic flow control system is configured to:

adjust a position of the proportional control valve to one of an open position, a closed position, or any variable position between the open position and the closed position:

regulate a variable pressure acting on the flow control member from a first pressure level to a second pressure level by adjusting the position of the proportional control valve, wherein the variable pressure includes the first pressure level and the second pressure level; and regulate a power demand placed on the engine from the pneumatic air compression system from a first power demand level to a second power demand level by regulating the variable pressure from the first pressure level to the second pressure level, wherein the engine is configured to provide power to the plurality of loads while still driving the pneumatic air compression system when the power demand placed on the engine from the pneumatic air compression system is at the second power demand level, and wherein the second power demand level is less than the first power demand level.

2. The service pack of claim 1, wherein one of the plurality of loads is a hydraulic pump.

3. The service pack of claim 1, wherein the service pack is configured to be mounted on a work vehicle.

4. The service pack of claim 1, wherein one of the plurality of loads is a generator configured to supply at least one of welding-type power to a welding-type load or ancillary power to an ancillary load.

5. The service pack of claim 1, wherein the proportional control valve comprises an electronically activated variable solenoid valve.

6. The service pack of claim 1, wherein the flow control member comprises an inlet valve control piston, and the pneumatic air compression system comprises an inlet valve configured to be actuated by the inlet valve control piston.

7. The service pack of claim 1, comprising a manual pressure release valve configured to be opened by an operator to release an internal pressure of the pneumatic air compression system.

8. The service pack of claim 1, wherein the pneumatic air compression system comprises a minimum pressure check valve configured to prohibit the compressed air from exiting the pneumatic air compression system when the pressure of the compressed air is below a predetermined pressure level.

9. The service pack of claim 1, comprising an air pressure gauge coupled to the pneumatic air compression system and comprising a display configured to display a pressure level within the pneumatic air compression system.

10. The service pack of claim 1, wherein the proportional control valve is configured to be positioned in an open position or a closed position to enable a remotely located controller to remotely set a pressure regulation set point for the service pack.

11. A service pack, comprising:

an engine configured to drive a plurality of loads, the plurality of loads comprising a pneumatic air compression system that includes an inlet valve, wherein the pneumatic air compression system is configured to receive inlet air and to compress the inlet air to produce compressed air;

a pneumatic flow control system comprising a proportional control valve coupled to the inlet valve, wherein the pneumatic flow control system is configured to:

adjust a position of the proportional control valve to one of an open position, a closed position, or any variable position between the open position and the closed position;

regulate a variable air flow rate through the inlet valve from a first flow rate to a second flow rate in response to the position of the proportional control valve, wherein the variable flow rate includes the first flow rate and the second flow rate; and regulate a power demand placed on the engine from the pneumatic air compression system from a first power demand level to a second power demand level by varying the variable flow rate from the first flow rate to the second flow rate, wherein the second power demand level is less than the first power demand level, and wherein the engine is configured to provide power to the plurality of loads while still driving the pneumatic air compression system when the power demand placed on the engine from the pneumatic air compression system is at the second power demand level.

12. The service pack of claim 11, wherein one of the plurality of loads is a hydraulic pump.

13. The service pack of claim 11, wherein the service pack is configured to be mounted on a work vehicle.

14. The service pack of claim 11, wherein one of the plurality of loads is a generator configured to supply at least one of welding-type power to a welding-type load or ancillary power to an ancillary load.

15. The service pack of claim 11, wherein the proportional control valve comprises an electronically activated variable solenoid valve.

16. A service pack, comprising:

an engine configured to drive a plurality of loads, the plurality of loads comprising a pneumatic air compression system that includes a flow control member, wherein the pneumatic air compression system is configured to receive inlet air and to compress the inlet air to produce compressed air; and a pneumatic flow control system comprising a manual control valve, wherein the pneumatic flow control system is configured to:

regulate a variable pressure acting on the flow control member from a first pressure level to a second pressure level by adjusting the position of the manual control valve to be in one of an open position, a closed position, or any position between the open position and the closed position, wherein the variable pressure includes the first pressure level and the second pressure level; and regulate a power demand placed on the engine from the pneumatic air compression system from a first power demand level to a second power demand level in response to regulating the variable pressure acting on the flow control member from the first pressure level to the second pressure level, wherein the engine is configured to provide power to the plurality of loads while still driving the pneumatic air compression system when the power demand placed on the engine from the pneumatic air compression system is at the second power demand level, and wherein the second power demand level is less than the first power demand level.

17. The service pack of claim 16, wherein one of the plurality of loads is a hydraulic pump.

18. The service pack of claim 16, wherein the service pack is configured to be mounted on a work vehicle.

19. The service pack of claim 16, wherein one of the plurality of loads is a generator configured to supply at least one of welding-type power to a welding-type load or ancillary power to an ancillary load.

20. The service pack of claim 16, wherein the manual control valve comprises a needle valve.

* * * * *